US008325963B2

(12) United States Patent
Kimura

(10) Patent No.: US 8,325,963 B2
(45) Date of Patent: Dec. 4, 2012

(54) BONE-CONDUCTION MICROPHONE BUILT-IN HEADSET

(75) Inventor: Tominori Kimura, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 416 days.

(21) Appl. No.: 12/633,384

(22) Filed: Dec. 8, 2009

(65) Prior Publication Data

US 2010/0172519 A1 Jul. 8, 2010

(30) Foreign Application Priority Data

Jan. 5, 2009 (JP) ..... 2009-000348

(51) Int. Cl.
*H04R 25/00* (2006.01)

(52) U.S. Cl. ..... 381/375; 381/151; 381/173; 381/370; 381/371; 381/380

(58) Field of Classification Search ..... 381/151, 381/173, 380, 370, 371, 375
See application file for complete search history.

(56) References Cited

U.S. PATENT DOCUMENTS 4,087,653 A * 5/1978 Frieder et al. ..... 379/430
4,150,262 A * 4/1979 Ono ..... 381/326
4,439,645 A * 3/1984 Scalzo ..... 381/74
7,466,838 B1 * 12/2008 Moseley ..... 381/370

FOREIGN PATENT DOCUMENTS

JP 7-1629 U 1/1995
WO WO 2008013487 A1 * 1/2008

* cited by examiner

*Primary Examiner* — Yuwen Pan
*Assistant Examiner* — Matthew Eason
(74) *Attorney, Agent, or Firm* — Sughrue Mion, PLLC

(57) ABSTRACT

A bone-conduction microphone built-in headset comprises: an ear pad; an ear cup capable of covering an ear; a piezoelectric element composing a bone-conduction microphone; a buffer material forming the ear pad; a baffle board provided between the ear pad and the ear cup; a wire laid from the piezoelectric element, in which the ear pad is provided on an opening end side of the ear cup, the piezoelectric element is provided inside the ear pad and supported by the buffer material to be pressed against a skin around the ear, the ear pad is detachably attached to the baffle board, and the baffle board has a connecter to which the wire is connected.

16 Claims, 2 Drawing Sheets

BONE-CONDUCTION MICROPHONE BUILT-IN HEADSET

BACKGROUND OF THE INVENTION

1. Field of the Invention

The present invention relates to a bone-conduction microphone built-in headset that collects sounds emitted from a person through bones of his or her body.

2. Description of the Related Art

Microphones applying bone conduction are used in cell phones, medical field, arms industry, and other various fields. A person usually senses a sound when vibratory pressure of air caused by a sound source vibrates an eardrum in his or her middle ear and the vibration is sent as a signal to the brain via an auditory nervous system and the like related to a sense of hearing. The sound thus sensed is referred to as an air-conduction sound.

Meanwhile, the bone conduction allows a person to sense a sound by vibrating apart of his or her skull with an oscillator in contact with his or her head. The sound thus sensed is referred to as a bone-conduction sound. As can be seen, the bone-conduction sound is transmitted in a different way from the air-conduction sound. Microphones and speakers applying bone conduction are advantageously used by a user who has difficulty hearing sounds because: the user is surrounded by noise; or a part of a user's organ of hearing sense, such as an eardrum, is impaired.

The user uses conventional bone-conduction microphones to communicate without being affected by the surrounding noise as much as possible by, for example: fixing a bone-conduction microphone unit at a user's throat with a neckband or an arm; or fixing the bone-conduction microphone unit to a tip of a headband or a headset or a tip of an arm connected to the tip of the headband or the headset and pressing the bone-conduction microphone unit to a user's cheek bone or temple with lateral pressure or with a user's hand.

As described above, the conventional bone-conduction microphone requires special arm, neckband, or headband to press the bone-conduction microphone unit against a part of a user's body at which a sound can be conducted efficiently. Thus, the bone-conduction microphone is usually troublesome and cumbersome upon wearing. Moreover, even when used together with a headphone and the like, the user has to take trouble of setting the head phone and the bone-conduction microphone separately.

Further, clear communication is difficult with the bone-conduction microphone mounted on the tip of the headband, the neckband, or the arm because the headband, the neckband, and the arm fixing the position of the bone-conduction microphone are vibrated by the surrounding noise and the noise is transferred to the bone-conduction microphone unit. A bone-conduction microphone is available in which the bone-conduction microphone unit is acoustically separated from the headband and the arm by interposing a rubber and the like. However, this type of bone-conduction microphone requires the user to manually place the microphone unit near a user's mouth. Therefore, fine sound quality can be obtained by using this type of bone-conduction microphone. However, the user cannot use a user's hand for any other purpose, because the user holds this type of bone-conduction microphone with the user's hand.

A wireless communication device comprising a wireless transceiver device, a headset, and a bone-conduction microphone is used for communication under huge noise. Because each of the elements are formed separately and connected via a connection cord and the like, operability and workability of the wireless communication device become low and wearing and removing the headset and the bone-conduction microphone become cumbersome.

As a solution to the problem, Japanese Unexamined Utility Model Application Publication No. 7-1629 discloses an integrated structure in which a headset incorporates a wireless transceiver circuit board, a speaker, and a bone-conduction microphone while an antenna wire is fixed along a headband thereof. Here, by employing a interactive communication or a voice operated transmission (VOX) circuit for the wireless transceiver circuit board, workability and operability for the user can be enhanced.

With the invention disclosed in the Japanese Unexamined Utility Model Application Publication No. 7-1629, a frequency characteristic of the bone-conduction microphone can be controlled so that the person on the other end of the line would not notice the surrounding noise transferred from the headband, neckband, or the arm because the interactive communication or the VOX circuit is used for the wireless transceiver circuit. Unfortunately, the technique provides a bone-conduction microphone with a lower performance and thus, adequacy as a communication tool is questionable. Moreover, the interactive communication or the VOX circuit degrades functionality of the bone-conduction microphone and thus, regardless of the surrounding noise, the voice cannot be clearly sent to the person on the other end of the line.

SUMMARY OF THE INVENTION

An object of the present invention is to provide a bone-conduction microphone built-in headset that can be worn by the user with the procedure similar to that in the case of a regular headphone and send a comfortable sound to a person on the other end of the line without being affected by a surrounding noise or the like.

A bone-conduction microphone built-in headset according to an embodiment of the present invention comprises: an ear pad; an ear cup capable of covering an ear; a piezoelectric element composing a bone-conduction microphone; a buffer material forming the ear pad; a baffle board provided between the ear pad and the ear cup; a wire laid from the piezoelectric element, in which the ear pad is provided on an opening end side of the ear cup, the piezoelectric element is provided inside the ear pad and supported by the buffer material to be pressed against a skin around the ear, the ear pad is detachably attached to the baffle board, and the baffle board has a connecter to which the wire is connected.

EFFECT OF THE INVENTION

The present invention provides a bone-conduction microphone built-in headset that can be worn by the user with the procedure similar to that in the case of a regular headphone. With the bone-conduction microphone built-in headset, the user can send a comfortable sound to the person on the other end of the line without being affected by a surrounding noise or the like.

DETAILED DESCRIPTION OF THE PREFERRED EMBODIMENTS

A headset according to an embodiment of the present invention is described below with reference to the accompanying drawings.

Figure 1:
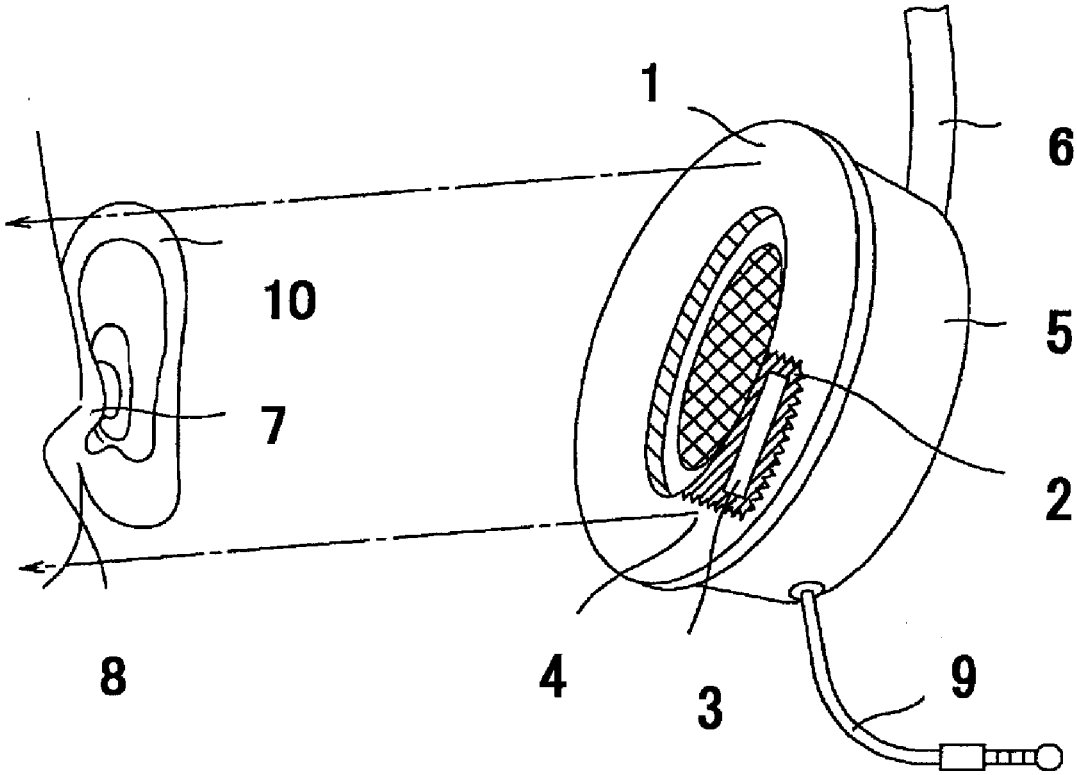
FIG. 1 is a perspective view schematically depicting a bone-conduction microphone built-in headset according to an embodiment of the present invention.

As shown in FIG. 1, this headset includes: an ear pad 1; a buffer material 2; a piezoelectric element 3 for a bone-conduction microphone; a cover 4; an ear cup 5; a hanger 6; and a microphone cord 9. The ear pad 1 has a form of a ring of a size capable of enclosing a user's auricle 10. FIG. 1 also shows a tragus 7 and an outer tragus 8. The headset according to the embodiment is composed of a pair of a left and a right headphone units formed as described above connected to each other via the hanger 6. FIG. 1 shows only one of the pair of the headphone units.

The ear pad 1 is detachably attached to an opening end side of the ear cup 5. The piezoelectric element 3 for the bone-conduction microphone is attached to a surface of the buffer material 2 composing the ear pad 1. Due to an elastic force of the hanger 6, the ear pads 1 of the left and the right headphone units are pressed against both sides of the head of the user upon wearing the headset. Thus, the piezoelectric element 3 for the bone-conduction microphone is provided between the cover 4 and the buffer material 2 to be pressed against the tragus 7 and the outer tragus 8, e.g., the area around the tragus 7, which is a part of an ear of the user.

The microphone cord 9 is laid from the ear cup 5 of one of the headphone units. The headset is worn as the hanger 6 is placed over a user's body, i.e., the user's head. The pair of the headphone units sandwich both sides of the user's head with the elastic force of the hanger 6. With the lateral pressure of the pair of headphone units, the piezoelectric element 3 for the bone-conduction microphone is supported by the buffer material 2 composing the ear pad 1 and is stably pressed against a person's outer tragus 8 or the tragus 7 via the cover 4.

When a person wearing the headset speaks, the voice is transmitted, from a cheekbone and the like connected to his or her throat, to the tragus 7 and a bone therebelow via an ear canal connected to the nose and inside the mouth. Thus, the tragus 7 and a bone therebelow vibrate in accordance with the voice. The piezoelectric element 3 for the bone-conduction microphone converts the vibration transmitted thereto via the cover 4 into an electric signal. The electric signal is sent through the microphone cord 9. The buffer material 2 prevents the piezoelectric element 3 for the bone-conduction microphone from being affected by an external vibration from the ear cup 5 and the baffle board 15. Moreover, as a characteristic of a piezoelectric element, the piezoelectric element 3 for the bone-conduction microphone is not sensitive to the vibration of air, and thus is less likely to collect the sound caused thereby. Therefore, only the voice of the user can be clearly sent to the person on the other end of the line without being affected by the surrounding noise and the sound emitted from the headphone. Moreover, the headset can be used only by wearing on a head and requires no external microphone. Thus, the user can give an impression that he or she is wearing a regular headphone and not the microphone since the microphone does not stand out.

Figure 2:
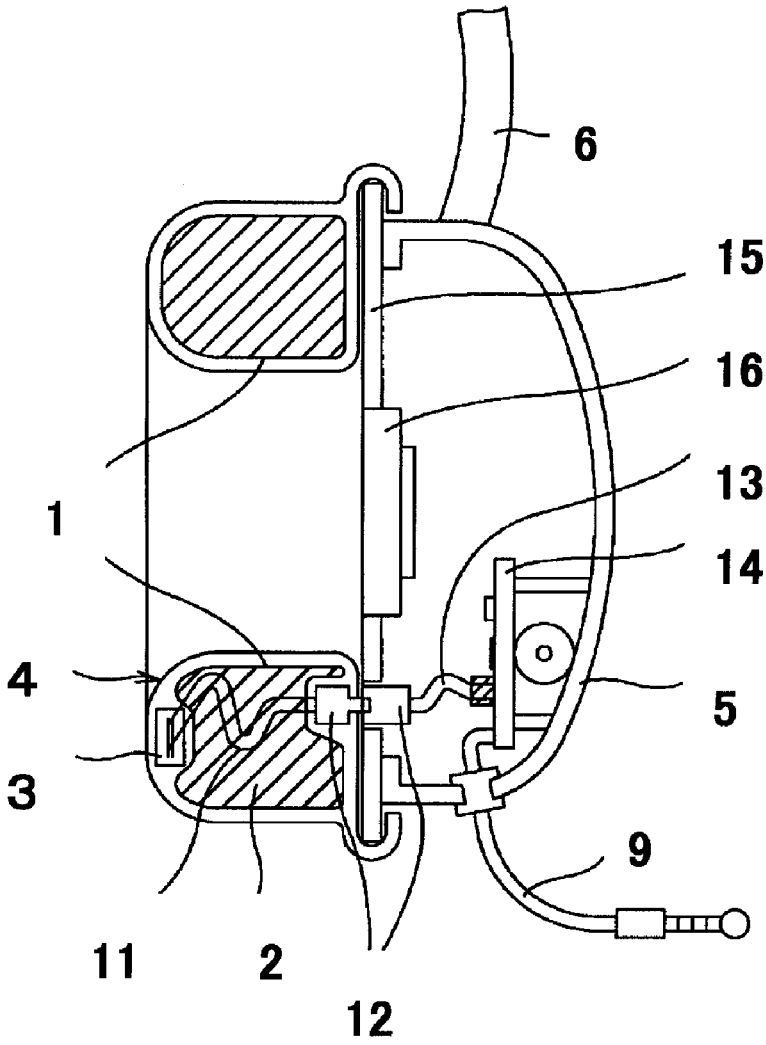
FIG. 2 is a cross sectional view depicting an internal structure of the bone-conduction microphone built-in headset according to the embodiment of the present invention.

FIG. 2 is a cross sectional view depicting an internal structure of the bone-conduction microphone built-in headset according to the present embodiment. As shown in FIG. 2, the bone-conduction microphone built-in headset includes the ear pad 1, the buffer material 2, the piezoelectric element 3 for the bone-conduction microphone, the cover 4, the ear cup 5, the microphone cord 9 as described with reference to FIG. 1, and further includes a microphone connection cord 11, a connector 12, an internal connection cord 13, a microphone amplifier board and a power source 14 thereof, the baffle board 15, and a drive unit 16.

The ear pad 1 composed of the buffer material 2, the piezoelectric element 3 for the bone-conduction microphone, the cover 4, and the microphone connection cord 11 is provided on the baffle board 15 as a turned-back portion formed of the cover 4, at an outer peripheral portion of the back side of the ear pad 1 covers an outer peripheral edge portion of the baffle board 15. The ear cup 5 is provided on the side of the baffle board 15 at which the ear pad 1 is not provided. The drive unit 16 is provided at a hole formed at the central portion of the baffle board 15. The drive unit 16 has a structure same as that of a speaker and is driven by an acoustic signal to emit an acoustic wave and transmit an air-conduction sound to the user's ear canal.

As described with reference to FIG. 1, the piezoelectric element 3 for the bone-conduction microphone is provided between the cover 4 and the buffer material 2. The microphone connection cord 11 for picking up an output from the piezoelectric element 3 for the bone-conduction microphone is loosely wired so as not to transmit the vibration from the baffle board 15 and the ear cup 5 to the piezoelectric element 3 for the bone-conduction microphone. The microphone connection cord 11 is connected to the internal connection cord 13 inside the ear cup 5 via the connector 12 attached to the baffle board 15. The piezoelectric element 3 for the bone-conduction microphone is connected to an appropriate connector of the microphone amplifier board and the power source 14 for driving the microphone amplifier via the internal connection cord 13. The microphone cord 9 outputs the voice amplified by the microphone amplifier and the power source 14 to the outside.

The structure described above allows the ear pad 1 to be detachably attached to the ear cup 5 while being configured to prevent external vibration from being transmitted to the piezoelectric element 3 for the bone-conduction microphone. Further, because the ear cup 5 incorporates the microphone cord 9, a compact headset is provided that allows verbal communication via the microphone cord 9 not affected by the external vibration and free of sound deterioration as a result of wireless communication.

The bone-conduction microphone built-in headset according to the present invention has been described based on the embodiment of the drawings. The structure is, however, not limited thereto. For example, the microphone amplifier board and the power source 14 may or may not be incorporated in the ear cup 5. In other words, in a case where an amplifier for the output of the piezoelectric element 3 for the bone-conduction microphone and a power source for the amplifier are required, the amplifier and the power source may be incorporated in the ear cup 5 or may be incorporated in a casing connected to the headphone including the piezoelectric element 3 for the bone-conduction microphone. The headset may be directly connected a microphone input plug of a communication device to use a microphone amplifier of the communication device. In such a case, a talk switch may be provided between the headset and the communication device so that the noise upon wearing the headset can be prevented from being sent to the person on the other end of the line.

The cover 4 may cover whole buffer material 2 or may cover only the surface of the piezoelectric element 3 for the bone-conduction microphone. In the latter case, the buffer material 2 serves as the ear pad 1.

The headset of the present invention may serve as an ear protection, e.g., an earmuff. In this case, an earmuff including the bone-conduction microphone is provided.

The headset of the present invention may also include a microphone that collects an environmental noise to have an active noise canceling function that generates a canceling signal having a phase opposite to that of an environmental noise signal generated in the microphone. In this case, an active noise canceling headphone or an active noise canceling earmuff is provided.

The piezoelectric element 3 for the bone-conduction may be provided to any of the left and the right headphone units or both.

A switch that allows a user to cut off the signal from the piezoelectric element 3 for the bone-conduction microphone may be provided between the piezoelectric element 3 for the bone-conduction microphone and the ear cup 5.

With the structure described above, the user can wear the bone-conduction microphone built-in headset configured as above with the same procedure as that in the case of a regular headphone and can also give an impression that he or she is wearing only a headphone without the microphone. The buffer material of the ear pad prevents the surrounding noise to be transmitted and allows the user to clearly send only his or her voice to the person on the other end of the line. Further, the easily handled bone-conduction microphone built-in headset can be obtained, which can be stably worn because the structure allows the microphone to be constantly pressed against a certain position just by wearing the headphone.

The bone-conduction microphone built-in headset of the present invention can be used, for example, in an audio player and a communication device for a person hard of hearing, and for communication over a cell phone and communication without being affected by noise.

What is claimed is:

1. A bone-conduction microphone built-in headset comprising:

an ear pad;

an ear cup capable of covering an ear;

a piezoelectric element composing a bone-conduction microphone;

a buffer material forming the ear pad;

a baffle board provided between the ear pad and the ear cup;

a wire laid from the piezoelectric element to a first connector, wherein the ear pad is provided on an opening end side of the ear cup, the piezoelectric element is provided inside the ear pad and supported by the buffer material to be pressed against a skin around the ear, the ear pad is detachably attached to the baffle board, and the baffle board has a second connecter which is configured to matchingly engage with the first connector to connect to the wire.

2. The bone-conduction microphone built-in headset according to claim 1, wherein the piezoelectric element is attached on a surface of the buffer material forming the ear pad.

3. The bone-conduction microphone built-in headset according to claim 1, wherein the piezoelectric element is provided between the buffer material forming the ear pad and the cover of the buffer material.

4. The bone-conduction microphone built-in headset according to claim 1, wherein the piezoelectric element is provided on the ear pad so as to be pressed against an area around a tragus.

5. The bone-conduction microphone built-in headset according to claim 1, wherein the wire laid from the piezoelectric element passes through an inside of the ear cup via the second connector on the baffle board and is connected to a microphone cord laid from the ear cup or a third connector provided inside the ear cup.

6. The bone-conduction microphone built-in headset according to claim 5, wherein the wire laid from the piezoelectric element is loosely arranged in the ear pad.

7. The bone-conduction microphone built-in headset according to claim 1, wherein the ear cup incorporates a microphone amplifier that amplifies an output signal from the piezoelectric element.

8. The bone-conduction microphone built-in headset according to claim 7, wherein the ear cup incorporates a power source that drives the microphone amplifier.

9. The bone-conduction microphone built-in headset according to claim 7 further comprising a wiring to receive a power source to drive the microphone amplifier from outside.

10. The bone-conduction microphone built-in headset according to claim 1, wherein a headphone unit is provided on the baffle board.

11. The bone-conduction microphone built-in headset according to claim 10 that optionally serves as an earmuff.

12. The bone-conduction microphone built-in headset according to claim 10 further comprising a microphone that collects an environmental noise to form an active noise canceling headphone that generates a canceling signal having a phase opposite to that of an environmental noise signal converted in the microphone and inputs the canceling signal to the headphone unit.

13. The bone-conduction microphone built-in headset according to claim 1, wherein a switch that can cut off an output signal from the piezoelectric element is provided between the piezoelectric element and the ear cup.

14. The bone-conduction microphone built-in headset according to claim 2, wherein the piezoelectric element is provided on the ear pad so as to be pressed against an area around a tragus.

15. The bone-conduction microphone built-in headset according to claim 3, wherein the piezoelectric element is provided on the ear pad so as to be pressed against an area around a tragus.

16. The bone-conduction microphone built-in headset according to claim 1, wherein the ear pad comprises an attachment portion disposed at an outer periphery of the ear pad proximate the ear cup opening, and the attachment portion is configured to engage with the baffle board, to detachably attach to the baffle board.

* * * * *